US006595282B2

(12) United States Patent
Smith, Jr.

(10) Patent No.: US 6,595,282 B2
(45) Date of Patent: Jul. 22, 2003

(54) FLUID FILLED DRILL PIPE PLUG

(75) Inventor: Sidney K. Smith, Jr., Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/832,028

(22) Filed: Apr. 10, 2001

(65) Prior Publication Data

US 2002/0144812 A1 Oct. 10, 2002

(51) Int. Cl.[7] ..... E21B 33/16
(52) U.S. Cl. ..... 166/177.3; 166/153
(58) Field of Search ..... 166/177.3, 154, 166/155, 153, 177.4, 187, 289, 291, 327, 373, 386

(56) References Cited

U.S. PATENT DOCUMENTS

| | | | |
|---|---|---|---|
| 1,639,079 | A | 8/1927 | Cushing |
| 2,294,521 | A | 9/1942 | Steadman et al. |
| 3,100,534 | A | 8/1963 | Herndon, Jr. et al. |
| 3,575,238 | A | 4/1971 | Shillander |
| 3,690,375 | A | 9/1972 | Shillander |
| 4,341,272 | A | 7/1982 | Marshall |
| 4,676,310 | A | 6/1987 | Scherbatskoy et al. |
| 4,729,429 | A | 3/1988 | Wittrisch |
| 4,858,687 | A | 8/1989 | Watson et al. |

FOREIGN PATENT DOCUMENTS

| | | |
|---|---|---|
| EP | 0225145 A2 | 6/1987 |
| GB | 2266547 A | 11/1993 |

*Primary Examiner*—Frank S. Tsay
(74) *Attorney, Agent, or Firm*—Steve Rosenblatt

(57) ABSTRACT

A wiper plug for downhole use is disclosed. It features an inflatable structure that allows it to ride inside tubulars that change or gradually vary in inside diameter. In a preferred embodiment the bladder is actuated by fluid displaced by a biased piston. The piston is capable of moving in opposite directions to allow original insertion into a launcher and subsequent bladder expansion. In another embodiment, the piston can be fluid driven in opposed directions by a pump and an on board control system which can regulate, on a real time basis, the contact pressure of the bladder to a predetermined level or range, as the bladder encounters varying interior wall diameters of the tubular string or associated equipment.

20 Claims, 4 Drawing Sheets

FLUID FILLED DRILL PIPE PLUG

FIELD OF THE INVENTION

The field of this invention relates to plugs inserted from the surface into a wellbore, generally used for fluid or cement displacement, wherein the plug comprises a size variation capability to sealingly conform to tubular size changes as it is propelled downhole.

BACKGROUND OF THE INVENTION

Wiper plugs are frequently used in completions such as when a liner is hung in casing and needs to be cemented. The cement is generally pumped downhole with the wiper plug in front. The wiper plug is launched from a holder at the surface and may need to travel through a variety of diameters before it comes to the receptacle where it "bumps" to give the surface personnel an indication of its arrival. In some applications, a wiper plug is used to separate well fluids pumped behind the cement to further displace the cement. In this application references to plug or wiper plug is intended to encompass drill pipe darts or plugs To avoid having to inventory a large variety of sizes for different applications the wiper plugs of the prior art had multiple fins so that at any given time one of the fins would sealingly engage the wall so the plug would be pumped further downhole. FIGS. 1 and 2 are illustrative of a prior art wiper plug. The wiper plug 10 is shown schematically just as it is about to be inserted into a drill pipe 12. There are three rows of fins 14, 16, and 18 of differing diameters. Again, this is done so one size wiper plug 10 fits many different applications. Depending on the application one or more of the fins need to be folded over themselves to such a degree that a "flowering" or "petaling" effect shown in FIG. 2 can occur. This effect creates a plurality of longitudinal troughs 20 when a fin is compressed. In a typical application the elastomer material used to make the fin has too little memory and fails to completely reassume its original shape when allowed to expand as the wiper plug 10 reaches a larger tubular, after it is launched. The problem this brings on is that cement or other fluids can pass around wiper plug 10 in the troughs that remain after reaching the bigger tubular. The retention of such troughs 20 also prevents a good circumferential seal from occurring at the interface of the fin extremity and the inner tubular wall.

It is an objective of the present invention to solve this problem so as to improve the performance of wiper plugs downhole. It is another objective to make the fin portion of a wiper plug flexible, to accommodate a variety of sized openings, even in a single run. Another object is to be able to control the amount of contact force against varying tubular inside diameters on a real time basis as the wiper plug progresses downhole. These and other objectives will become more clear to those skilled in the art from a review of the preferred embodiment, described below.

The following patents represent plugs, packers and other downhole devices that have been used downhole: U.S. Pat. Nos. 3,100,534; 4,676,310; 4,729,429; 4,341,272; 3,690,375; 3,575,238; 2,294,521; and 1,639,079.

SUMMARY OF THE INVENTION

A wiper plug for downhole use is disclosed. It features an inflatable structure that allows it to ride inside tubulars that change or gradually vary in inside diameter. In a preferred embodiment the bladder is actuated by fluid displaced by a biased piston. The piston is capable of moving in opposite directions to allow original insertion into a launcher and subsequent bladder expansion. In another embodiment, the piston can be fluid driven in opposed directions by a pump and an on board control system which can regulate, on a real time basis, the contact pressure of the bladder to a predetermined level or range, as the bladder encounters varying interior wall diameters of the tubular string or associated equipment.

DETAILED DESCRIPTION OF THE PREFERRED EMBODIMENT

Figure 2:
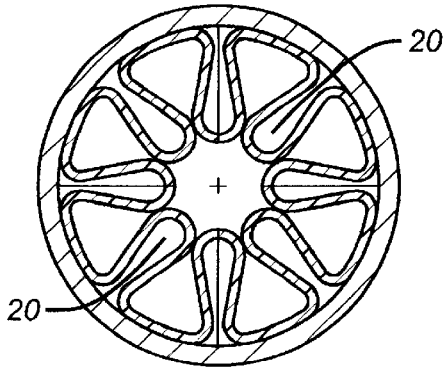
(PRIOR ART) FIG. 2
FIG. 2 is the view along lines 2—2 of FIG. 1.
Figure 1:
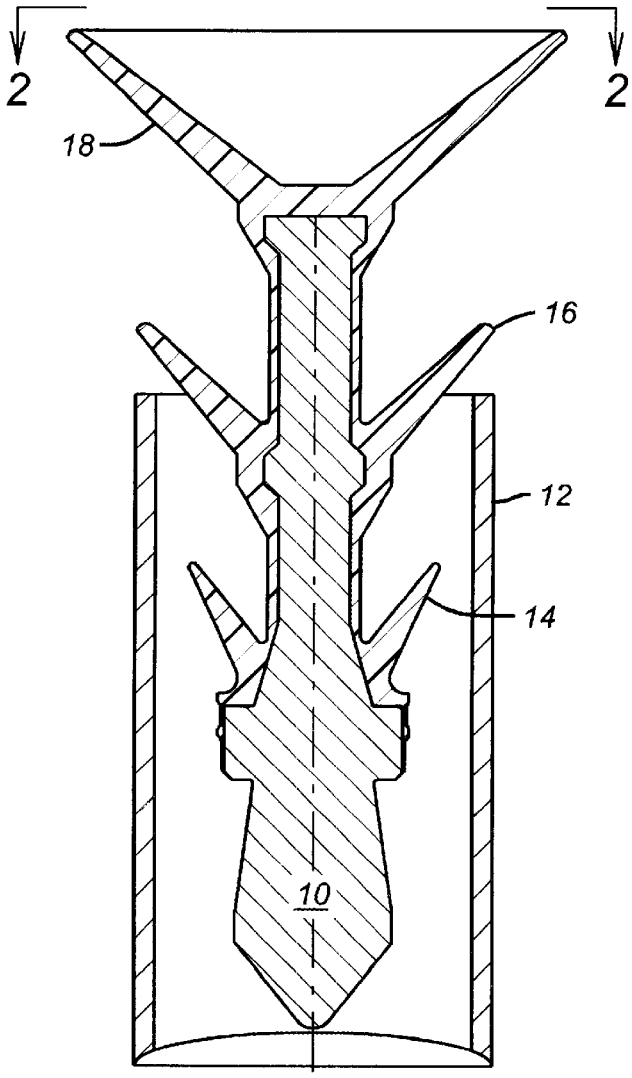
(PRIOR ART) FIG. 1
FIG. 1 is a section view in elevation of a wiper plug known in the art.
Figure 3:
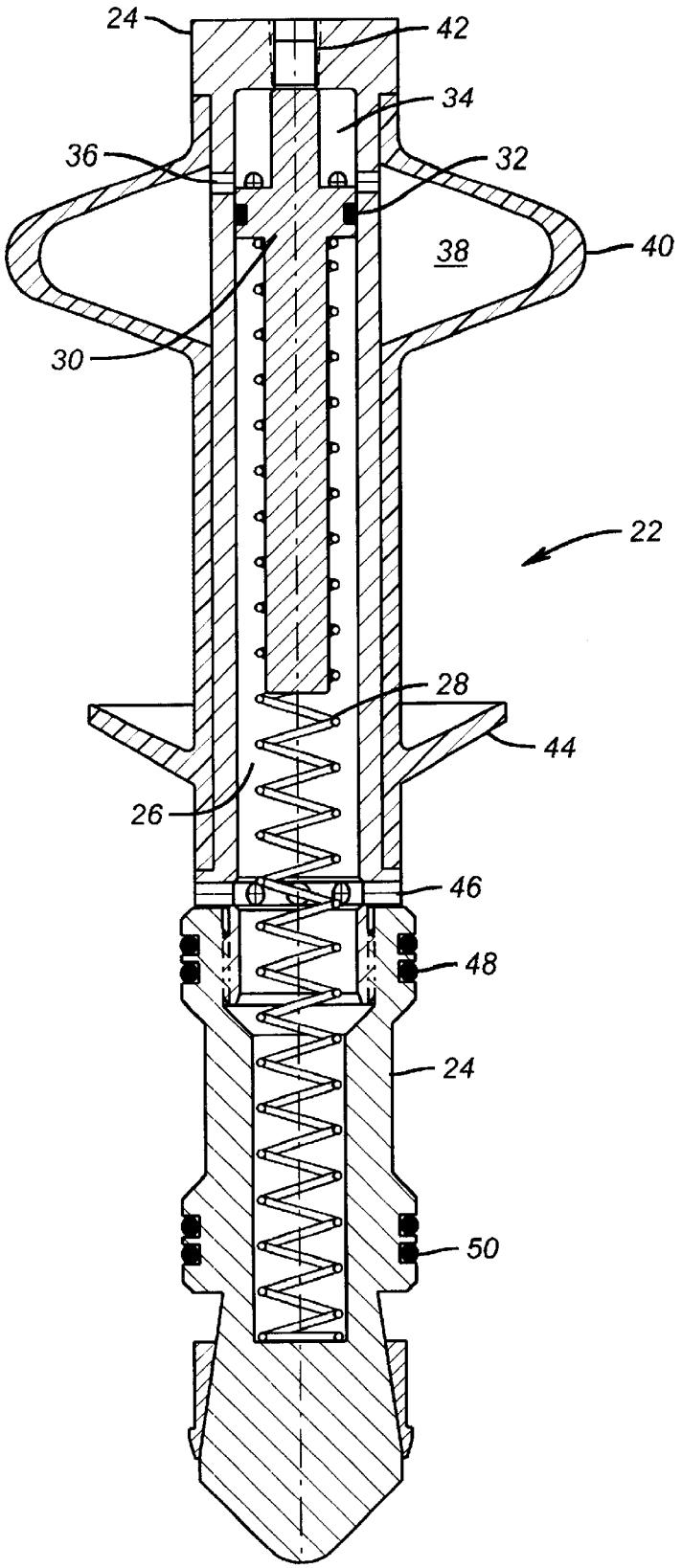
FIG. 3 is a section view in elevation of the wiper plug of the present invention just before it is inserted into a launcher (not shown)

Referring now to FIG. 3, the wiper plug 22, is shown after it has been made ready for use and before it is inserted into a launcher (not shown). Wiper plug 22 has a body 24 with an internal passage 26. In passage 26 is a spring 28 which biases a piston 30. Piston 30 has a seal 32 and it separates passage 26 from passage 34. Those skilled in the art will appreciate that movement of piston 30 changes the volume of passages 26 and 34 in an inverse relationship. Ports 36 provide access from passage 34 into cavity 38 formed by inflatable element 40 mounted to body 24. A fill port 42 allows an initial charge of fluid to be placed in passage 34. Mounted to body 24 is a lower fin 44 which, in the preferred embodiment is made from an elastomer which is integral to element 40. Ports 46 allow piston 30 to compress spring 28 so as to decrease the volume of chamber 38 so that the wiper plug can be introduced into the tubular launcher (not shown). In order to accomplish that step, the element 40 is brought closer to body 24 as piston 30 moves down against the bias of spring 28 and fluid, most likely air since this procedure occurs at the surface, is displaced out of openings 46.

Figure 4:
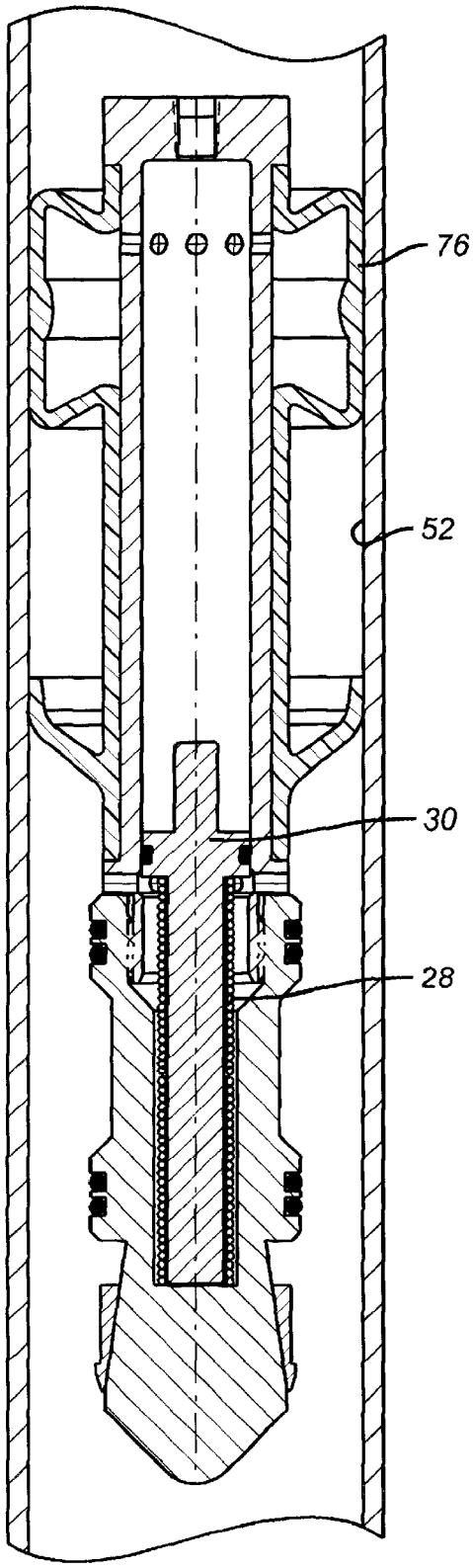
FIG. 4 is the wiper plug of FIG. 3 shown driven into the small diameter tubular with the piston in a bottomed position.

FIG. 4 shows what happens when the element 40 is compressed to the smallest anticipated diameter during the run of the wiper plug 22. This can occur at the end of the run, when the wiper plug 22 lands in a receptacle (not shown) and seals against it with seals 48 and 50. The element 40 takes the shape of the tubular inner wall 52 while piston 30 bottoms in passage 26 and spring 28 is fully compressed. As the volume of cavity 38 changes, the lower fin 44 can also seal, depending on its diameter and the diameter encountered along the trip downhole.

The advantage of wiper plug 22 should now be readily apparent. The outer dimensions of the element 40 can flex to accommodate diameter changes, both gradual and sudden that occur along the trip downhole. The rate of spring 28 can be preselected to approximate a contact force of the element 40 on the tubular inner wall 52 knowing the anticipated diameters to be encountered. Diameter constraints on the body 24 may dictate a specific length in order to allow sufficient volume displacement by the piston 30. Passage 34 and cavity 38 should not have compressible fluid in them but instead should be full of a suitable low viscosity mineral oil or the like. As long as the piston is within its stroke limits, compensation in size of element 40 in both directions is possible. Lower fin 44 is optional and can be eliminated, depending on the application.

Figure 5:
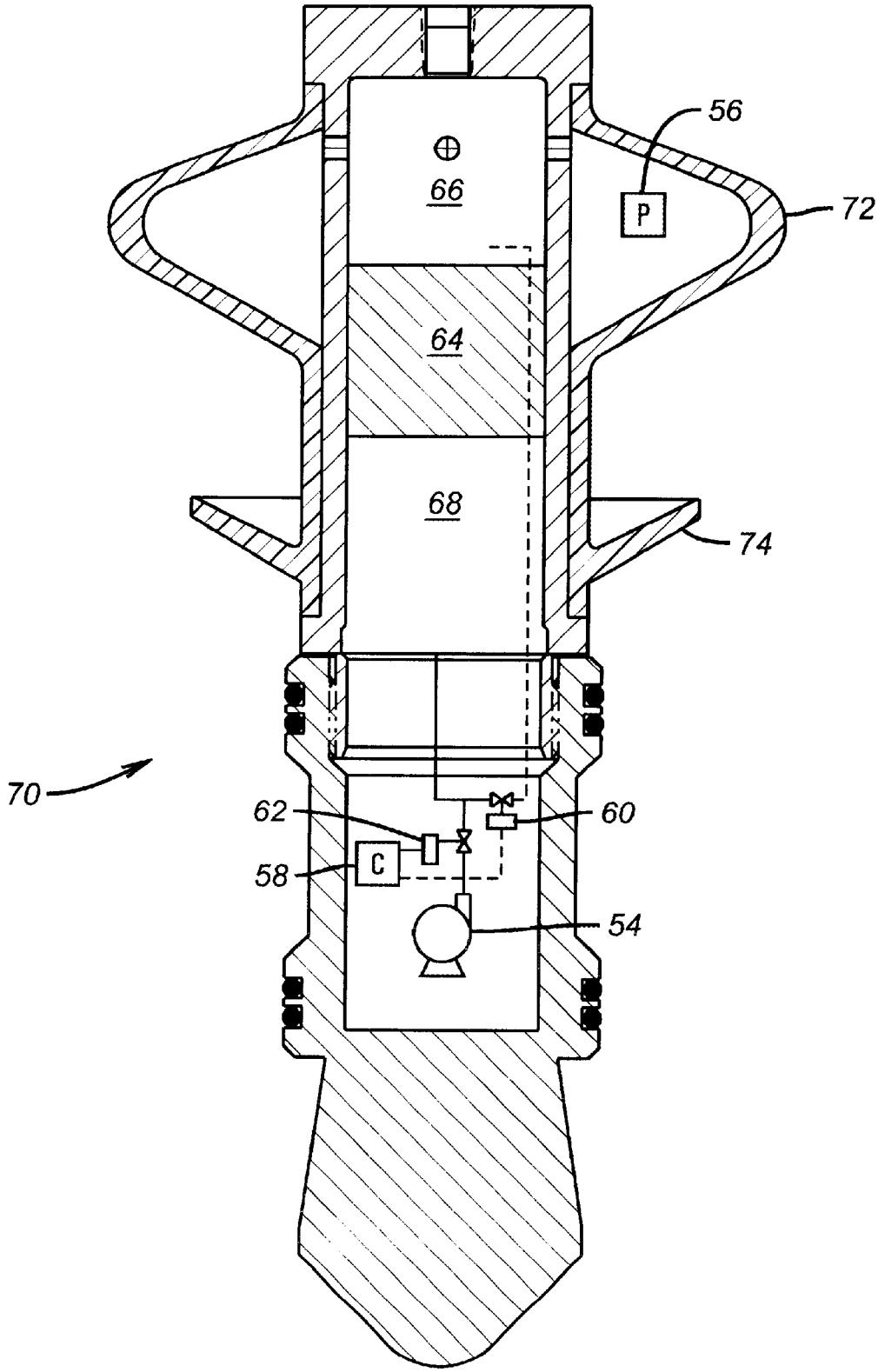
FIG. 5 is an alternative embodiment to FIG. 3, shown in section.

Shown schematically in FIG. 5, is an alternative embodiment. It has an on board pump 54 which is regulated by a pressure sensor 56 providing a signal to a processor 58 which , in turn controls the pump 54 and the valve actuators 60 and 62 to selectively direct fluid above piston 64 in cavity 66 or below piston 64 in cavity 68. All other components are the same as in FIG. 3. This embodiment may cost somewhat more to produce, but is has the advantage of allowing a present pressure to be maintained in real time as the wiper plug 70 travels downhole. The sensed pressure can also be communicated to the surface using signals sent by the processor 58 such as ultrasonic or use of any other known signal transmission technology. In that way, the condition of the element 72 can be monitored at the surface as it progresses downhole. An optional lower fin 74 can be employed as a backup to element 72 or to allow sealing against a broader range of tubular diameters depending on the relative sizes of fin 74 and element 72. In the embodiment of FIG. 5, the spring is eliminated and the piston 64 is driven in opposed directions. The system of FIG. 5 is more responsive and has greater flexibility for the presetting of the contact force regardless of the particular diameter encountered, all within a range of the volume displacement capabilities of the piston 64 driven by pump 54. Since wiper plug 70 is generally milled out at the end of its run, the FIG. 5 embodiment may take a little longer to mill and involves a higher initial cost. Extensive use of non-metallic components can also reduce milling time at the conclusion of the run. Surface commands to the processor 58 on its way downhole are also contemplated to regulate the contact pressure or for other reasons. The wiper plug 70 can also transmit its depth or forward progress on a real time basis for confirmation that it has reached the intended receptacle when surface personnel feel it "bump" at the surface.

The wiper plugs illustrated in FIG. 3 or 5 can be used in a variety of applications downhole, such as in the context of cementing and in other applications such as a pipeline pig. In any application, the full circumferential contact achieved by element 40 in either embodiment is a marked improvement from the cone shaped fins such as 16 which create troughs 20 which can be potential paths for fluid to bypass the wiper plug 22 and impede its forward progress to its ultimate destination. There is also a greater contact area with the element 40 than the fins such as 16. Element 40 can also be controlled mechanically by moving its ends closer together or further apart to compensate for changes in the tubing diameter through which it passes. Element 40 makes a wide band of longitudinal contact 76 as opposed to the near line contact made by the fins such as 16 near its end 78.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claims, including the full range of equivalency to which each element thereof is entitled.

What is claimed is:

1. A wiper plug for movement inside a tubular having an inner wall, comprising:

a plug body having no passages therethrough;

an element extending from said body into engagement with the inner wall; and a force applying device, mounted to said body, acting on said element, apart from any potential energy force that may be stored in the element, to alter the size of said element responsive to size changes of the inner wall.

2. The plug of claim 1, wherein:

said force applying device exerts a fluid force on said element.

3. The plug of claim 2, wherein:

said force applying device comprises a movable piston selectively supplying and removing fluid to a cavity defined between said body and said element.

4. The plug of claim 3, wherein:

said element comprises a tubular flexible shape secured at opposed ends to said body;

said body comprises a passage in which said piston is mounted for movement in opposed directions, said body comprising at least one element opening to allow fluid communication between said passage and said cavity.

5. The plug of claim 1, wherein:

said force applying device exerts a mechanical force on said element.

6. The plug of claim 1, wherein:

said element makes contact with the inner wall for 360 degrees circumferentially, without troughs which could permit fluid to bypass the element impeding forward progress of said body in the tubular.

7. The plug of claim 6, wherein:

said element makes a band of longitudinal contact with the tubular.

8. The plug of claim 7, wherein:

said force applying device exerts a fluid force on said element;

said force applying device comprises a movable piston selectively supplying and removing fluid to a cavity defined between said body and said element.

9. The plug of claim 1, wherein:

said element is an inflatable flexible tubular shape.

10. The plug of claim 9, wherein:

said element comprises, at least in part, an elastomer.

11. A wiper plug for movement inside a tubular having an inner wall, comprising:

a body;

an element extending from said body into engagement with the inner wall; and a force applying device, mounted to said body, acting on said element to alter the size of said element responsive to size changes of the inner wall;

said force applying device exerts a fluid force on said element;

said force applying device comprises a movable piston selectively supplying and removing fluid to a cavity defined between said body and said element; and said piston is biased to push fluid into said cavity.

12. A wiper plug for movement inside a tubular having an inner wall, comprising:

a body;

an element extending from said body into engagement with the inner wall; and a force applying device, mounted to said body, acting on said element to alter the size of said element responsive to size changes of the inner wall;

said force applying device exerts a fluid force on said element;

said force applying device comprises a movable piston selectively supplying and removing fluid to a cavity defined between said body and said element; and said piston is driven in opposed directions by a pressure source on said body.

13. The plug of claim 12, further comprising:

a pressure sensor in said cavity:

a processor to receive sensed pressure signals from said pressure sensor;

a control system regulated by said processor to control movement of said piston in opposed directions.

14. The plug of claim 13, wherein:

said processor is programmable from the surface to alter the pressure in said cavity as the plug advances in the tubular.

15. The plug of claim 14, wherein:

said processor sends a signal to the surface to indicate its location as it advances in the tubular.

16. A wiper plug for movement inside a tubular having an inner wall, comprising:

a body;

an element extending from said body into engagement with the inner wall; and a force applying device, mounted to said body, acting on said element to alter the size of said element responsive to size changes of the inner wall;

said force applying device exerts a fluid force on said element;

said force applying device comprises a movable piston selectively supplying and removing fluid to a cavity defined between said body and said element;

said element comprises a tubular flexible shape secured at opposed ends to said body;

said body comprises a passage in which said piston is mounted for movement in opposed directions, said body comprising at least one element opening to allow fluid communication between said passage and said cavity said piston divides said passage into an upper passage and a lower passage, the volume of said passages varying inversely upon piston movement; and said lower passage comprises a biasing member acting on said piston.

17. The plug of claim 16, wherein:

said element opening is located in said upper passage;

said lower passage further comprises at least one vent opening to allow fluid to pass into or out of said lower passage depending on piston movement.

18. A wiper plug for movement inside a tubular having an inner wall, comprising:

a body;

an element extending from said body into engagement with the inner wall; and a force applying device, mounted to said body, acting on said element to alter the size of said element responsive to size changes of the inner wall;

said element makes contact with the inner wall for 360 degrees circumferentially, without troughs which could permit fluid to bypass the element impeding forward progress of said body in the tubular;

said element makes a band of longitudinal contact with the tubular;

said force applying device exerts a fluid force on said element;

said force applying device comprises a movable piston selectively supplying and removing fluid to a cavity defined between said body and said element;

said piston is biased to push fluid into said cavity;

said element comprises a tubular flexible shape secured at opposed ends to said body;

said body comprises a passage in which said piston is mounted for movement in opposed directions, said body comprising at least one element opening to allow fluid communication between said passage and said cavity.

19. The plug of claim 18, wherein:

said piston divides said passage into an upper passage and a lower passage, the volume of said passages varying inversely upon piston movement; and said lower passage comprises a biasing member acting on said piston.

20. The plug of claim 19, wherein:

said element opening is located in said upper passage;

said lower passage further comprises at least one vent opening to allow fluid to pass into or out of said lower passage depending on piston movement.

* * * * *